US008482217B2

(12) United States Patent
Nagase et al.

(10) Patent No.: US 8,482,217 B2
(45) **Date of Patent: *Jul. 9, 2013**

(54) HIGH PRESSURE DISCHARGE LAMP BALLAST AND LIGHT SOURCE APPARATUS

(75) Inventors: Tooru Nagase, Gyoda (JP); Yoshiaki Komatsu, Gyoda (JP); Shinichi Suzuki, Gyoda (JP); Makoto Ohkahara, Gyoda (JP); Hirokazu Harasawa, Gyoda (JP); Yoshiaki Kuroda, Gyoda (JP)

(73) Assignee: Iwasaki Electric Co., Ltd., Chuo-ku, Tokyo (JP)

( * ) Notice: Subject to any disclaimer, the term of this patent is extended or adjusted under 35 U.S.C. 154(b) by 318 days.

This patent is subject to a terminal disclaimer.

(21) Appl. No.: 12/936,413

(22) PCT Filed: Mar. 18, 2009

(86) PCT No.: PCT/JP2009/055260

§ 371 (c)(1),
(2), (4) Date: Oct. 5, 2010

(87) PCT Pub. No.: WO2009/125660

PCT Pub. Date: Oct. 15, 2009

(65) Prior Publication Data

US 2011/0025222 A1 Feb. 3, 2011

(30) Foreign Application Priority Data

Apr. 8, 2008 (JP) ..... 2008-100142

(51) Int. Cl.
*H05B 41/36* (2006.01)

(52) U.S. Cl.
USPC ..... 315/291; 315/224; 315/307; 353/85

(58) Field of Classification Search
USPC ..... 315/291, 82, 307, 287; 353/85, 97; 362/263–265, 583
See application file for complete search history.

(56) References Cited

U.S. PATENT DOCUMENTS 5,365,151 A 11/1994 Spiegel et al.
6,215,252 B1 * 4/2001 Stanton ..... 315/224

(Continued)

FOREIGN PATENT DOCUMENTS

CN 1311290 4/2007
EP 0 785 702 7/1997

(Continued)

OTHER PUBLICATIONS

Notification of Transmittal of Translation of the International Preliminary Report on Patentability (Application No. PCT/JP2009/055260) mailed Dec. 9, 2010.

(Continued)

*Primary Examiner* — David H Vu
(74) *Attorney, Agent, or Firm* — Eric J. Robinson; Robinson Intellectual Property Law Office, P.C.

(57) ABSTRACT

The high pressure discharge lamp ballast drives a high pressure discharge lamp with a synthesized-waveform alternating current made of multiple frequency components, the high pressure discharge lamp having a pair of electrodes disposed to face each other. The ballast controls a ratio of the multiple frequency components per unit time; applies a synthesized-waveform current in accordance with the ratio to the high pressure discharge lamp; and detects a lamp parameter of the high pressure discharge lamp. The control circuit is configured to shift the ratio to a first ratio when the lamp parameter is in a first state, and shifts the ratio to a second ratio when the lamp parameter is in a second state. The control circuit changes the ratio stepwise when the ratio is shifted from the first ratio to the second ratio, or when the ratio is shifted from the second ratio to the first ratio.

14 Claims, 7 Drawing Sheets

U.S. PATENT DOCUMENTS

| | | | | |
|---|---|---|---|---|
| 6,963,176 | B2 * | 11/2005 | Onishi et al. | 315/291 |
| 7,285,920 | B2 * | 10/2007 | Riederer et al. | 315/307 |
| 7,316,483 | B2 * | 1/2008 | Moench et al. | 353/85 |
| 7,511,433 | B2 * | 3/2009 | Okawa | 315/224 |
| 7,637,619 | B2 * | 12/2009 | Matsumoto et al. | 353/85 |
| 7,845,805 | B2 * | 12/2010 | Okamoto et al. | 353/85 |
| 2004/0223125 | A1 | 11/2004 | Tamaru et al. | |
| 2007/0024207 | A1 * | 2/2007 | Harada et al. | 315/291 |
| 2007/0164687 | A1 | 7/2007 | Watanabe et al. | |
| 2007/0188107 | A1 | 8/2007 | Okawa | |
| 2008/0024853 | A1 | 1/2008 | Tanaka et al. | |
| 2008/0116820 | A1 * | 5/2008 | Ozasa et al. | 315/246 |

FOREIGN PATENT DOCUMENTS

| | | |
|---|---|---|
| EP | 1 624 733 | 2/2006 |
| JP | 2003-197386 | 7/2003 |
| JP | 2005-038815 | 2/2005 |
| JP | 2006-120654 | 5/2006 |
| JP | 2006-185663 | 7/2006 |
| JP | 3851343 | 11/2006 |
| JP | 2007-214010 | 8/2007 |
| JP | 2007-242421 | 9/2007 |
| WO | WO 2006/016335 | 2/2006 |

OTHER PUBLICATIONS

International Search Report for Application Serial No. PCT/JP2009/055260 dated May 19, 2009.

European Search Report (Application No. 09729577.8) dated Dec. 19, 2012.

Chinese Office Action (Application No. 200980112458.3) dated Nov. 22, 2012.

* cited by examiner

PRIOR ART

PRIOR ART

PRIOR ART

HIGH PRESSURE DISCHARGE LAMP BALLAST AND LIGHT SOURCE APPARATUS

TECHNICAL FIELD

The present invention relates to a high pressure discharge lamp ballast for driving a high pressure discharge lamp by supplying an AC lamp current, a light source apparatus using the same, and a method for driving a high pressure discharge lamp.

BACKGROUND ART

Light source apparatuses using a short-arc high pressure discharge lamp in combination with a reflector are employed as backlights of projectors, projection TVs, and so forth.

In recent years, there has been a demand for these high pressure discharge lamps with respect to the improvement in properties such as further enhancement in brightness, reduction in size, and longer lifetime. Particularly, the longer lifetime is highly desired, further improvement of which is required. In this regard, in order to extend the lifetime, it is an important issue to maintain the arc length during the lifetime. More specifically, the driving voltage (hereinafter, referred to as a "lamp voltage") of the high pressure discharge lamp needs to be maintained at a constant level.

For this reason, these high pressure discharge lamps are filled with mercury and a minute amount of halogen. By the halogen cycle, tungsten that is a material for an electrode evaporated during driving returns to a tip of the electrode. This suppresses the fluctuation in arc length during the lifetime, thereby maintaining the lamp voltage.

In fact, however, it is known that the lamp voltage decreases at the initial period of approximately several tens of hours of accumulative driving time of the high pressure discharge lamp, while the lamp voltage increases for a while during the subsequent long lifetime.

Additionally, the lamp voltage also shows behaviors such as increase and decrease during the lifetime due to the variation among individual lamps and the variation in driving condition such as the outside temperature.

However, it is difficult to control these fluctuations in lamp voltage under the same driving frequency condition. For this reason, a proposal is made to achieve the improvements by changing the frequency. One example is a method for controlling the lamp voltage by changing the driving frequency in accordance with the lamp voltage while the lamp is driven, as described in Patent Document 1. Specifically, the driving frequency is controlled to be increased when the lamp voltage falls below a certain reference value, while the driving frequency is decreased when the lamp voltage exceeds a certain reference value. This is the control based on the known fact that the lamp voltage tends to increase in its behavior when the lamp-driving frequency is high, whereas the lamp voltage tends to decrease in its behavior when the driving frequency is low (hereinafter, respectively referred to as a "high frequency" and a "low frequency").

Further, as another countermeasure, proposed is a control in which the driving frequency is changed by switching among two or more different values multiple times to drive a lamp, as in Patent Document 2, for example. Specifically, a lamp current waveform is employed which is synthesized from multiple frequency components including the high frequency component and the low frequency component in a predetermined balance from the beginning. Thus, the effect of the high frequency and the effect of the low frequency are to be demonstrated together.

More specifically, a square wave alternating current that is a combination of multiple driving frequencies shown in FIG. 9 is applied to drive a high pressure discharge lamp. Further, FIG. 10A is a graph showing the relationship between accumulative driving time and a luminance maintenance rate in the driving test. FIG. 10B is a graph showing the relationship between the accumulative driving time and the lamp voltage in the driving test. According to the result of this test, the high pressure discharge lamp is designed to be driven while multiple driving frequencies are selected appropriately and the behavior of the lamp voltage and the combinations of the driving frequencies are switched so as to achieve the preferable the luminance maintenance rate during the lifetime of the lamp and behavior of the lamp voltage.

However, during the lifetime of the lamp, optimal conditions for controlling and maintaining the growth and wear of a protrusion at an electrode change due to the variation in characteristics among individual lamps, the driving condition, and the like. For this reason, it is desirable, also in controlling the lamp voltage with multiple driving frequencies, to detect lamp parameters and to change the driving frequency conditions in accordance with the driving parameters.

Furthermore, in a light source apparatus, there is a small luminance variation synchronized with the lamp-driving frequency. This variation may interfere with the frequency of a video synchronization signal in the light source apparatus, causing a stripe pattern on a projected video in some cases. To avoid this, only limited several driving frequencies can be used within a practical range of lamp-driving frequencies. Thus, it is desirable to consider the changing of the driving frequency conditions also in a case where the driving frequency cannot be changed freely.

Taking the above into consideration, it has been proposed that an ideal lamp-voltage control would be achieved if the control is carried out in which multiple driving frequencies are combined and the combinations of the driving frequencies are changed in accordance with the lamp parameters during the driving. It has been believed that this control can suppress the fluctuation in arc length and thus can extend the lifetime.

Patent Document 1: Japanese Patent Application Publication No. 2006-185663

Patent Document 2: Japanese Patent No. 3851343

DISCLOSURE OF THE INVENTION

Problems to be Solved by the Invention

As a result of earnest studies conducted by the inventors on the lamp-voltage control by switching the lamp-driving frequencies, however, it was revealed that there is a problem in merely performing the control in the above described manner that multiple driving frequencies are combined and the combinations of the driving frequencies are changed in accordance with the lamp parameters during the driving.

The inventors prototyped a high pressure discharge lamp ballast having a function of switching a lamp-driving frequency, and conducted a driving test for a lamp in the ballast to observe and measure lamp voltages during the test.

As a result, the following facts were observed. Specifically, it was found that the lamp voltage during the driving tended to increase at a high frequency, while the lamp voltage tended to decrease at a low frequency. However, this was a result of long-term observation within the driving time. Immediately after the driving frequency was switched, the lamp voltage showed totally different behaviors.

Specifically, as shown in FIG. 11, the following behaviors were recognized. When the driving frequency was switched from low frequency to high frequency, the lamp voltage decreased by several V to more than ten V in a short term (although should have increased in a long term). In contrast, when the driving frequency was switched from high frequency to low frequency, the lamp voltage increased by several V to more than ten V in a short term (although should have decreased in a long term).

The lamp voltage shows such behaviors presumably because of the following reasons.

When the driving frequency is switched from low frequency to high frequency, the period for the polarity inversion becomes shorter. The number of times electrons collide at a tip of an electrode operating as an anode is decreased, and the temperature of the electrode tip is decreased. Since the temperature of the electrode tip drastically decreases immediately after the switching, the electrode evaporates less, and a new protrusion is formed on the protrusion on the electrode tip in a short term. This makes the arc length short, causing the lamp voltage to decrease. After the driving is continued at a high frequency for a while, the protrusion evaporates, and the lamp voltage starts increasing as the known facts.

In contrast, when the driving frequency is switched from high frequency to low frequency, the period for the polarity inversion becomes longer. It is presumed that because the number of times electrons collide at a tip of an electrode is increased, the temperature of the electrode tip is increased, and the evaporation of the electrode is facilitated. Since the temperature of the electrode tip drastically increases immediately after the switching, a protrusion at the electrode tip evaporates. This makes the arc length long, causing the lamp voltage to increase. After the driving is continued at a low frequency for a while, another protrusion is formed at the electrode tip by the halogen cycle, and the lamp voltage starts decreasing.

For this reason, as in the controlling in Patent Document 1, when the lamp voltage falls below a certain reference value, if the driving frequency is simply switched to a high frequency at which the lamp voltage tends to increase, the lamp voltage further decreases by several V to more than ten V immediately after the switching. As a result, since the lamp voltage cannot be maintained within a desired lamp-voltage range, the output current of the ballast becomes excessive, causing an unfavorable condition such as an increase in component temperature. Further, when the lamp voltage falls below a range of a rated power, a problem such as the problem that the lamp cannot be driven at a rated power may be caused.

In contrast, when the lamp voltage exceeds a certain reference value, if the driving frequency is simply switched to a low frequency at which the lamp voltage tends to decrease, the lamp voltage further increases by several V to more than ten V immediately after the switching. As a result, the lamp voltage cannot be maintained within the certain range. Consequently, the arc length may be increased, which causes a problem such as a decrease in illuminance.

The inventors further earnestly conducted studies, and prototyped a high pressure discharge lamp ballast which drives a lamp at multiple driving frequencies. The inventors conducted a test in which high frequencies at which the lamp voltage tends to increase were combined with low frequencies at which the lamp voltage tends to decrease and then the content rates of the respective driving frequencies during the driving of the lamp per unit time were changed.

As a result, even when the lamp was driven with the multiple driving frequencies combined, the phenomena as shown in FIG. 12 were observed, which are the same as the above described short-term fluctuations in lamp voltage due to the switching of the driving frequencies. Specifically, immediately after the content rate of the low frequency per unit time was increased to decrease the lamp voltage, the lamp voltage increased by several V. In contrast, immediately after the content rate of the high frequency per unit time was increased to increase the lamp voltage, the lamp voltage decreased by several V.

Hence, as to the control by switching driving frequencies, it has been found out that an appropriate control should be carried out from the short-term standpoint besides the long-term standpoint with respect to each frequency and the lamp voltage.

Means for Solving the Problems

A first aspect of the present invention is a high pressure discharge lamp ballast for driving a high pressure discharge lamp with a synthesized-waveform alternating current made of multiple frequency components, the high pressure discharge lamp including a pair of electrodes disposed to face each other, the ballast including: a control means for controlling a component contained ratio of the multiple frequency components per unit time; an output means for applying a synthesized-waveform current in accordance with the component contained ratio to the high pressure discharge lamp; and a detection means for detecting a lamp parameter related to the high pressure discharge lamp. In the high pressure discharge lamp ballast, the control unit is configured to shift the component contained ratio to a first component contained ratio when the lamp parameter is in a first state, and to shift the component contained ratio to a second component contained ratio when the lamp parameter is in a second state. The control unit is further configured to change the component contained ratio stepwise when the component contained ratio is shifted from the first component contained ratio to the second component contained ratio, or when the component contained ratio is shifted from the second component contained ratio to the first component contained ratio.

A second aspect of the present invention is a high pressure discharge lamp ballast for driving a high pressure discharge lamp with a synthesized-waveform alternating current made of frequency components f1 and f2 (f1<f2), the high pressure discharge lamp including a pair of electrodes disposed to face each other, the ballast including: a control means for controlling each of content rates of the frequency components f1 and f2 per unit time; an output means for applying a synthesized-waveform current in accordance with the content rates to the high pressure discharge lamp; and a detection means for detecting a lamp voltage of the high pressure discharge lamp. In the high pressure discharge lamp ballast, the control means is configured to shift the content rate of the f2 to $R_L$% when the lamp voltage exceeds a predetermined value V, and to shift the content rate of the f2 to $R_H$% ($0 \leqq R_L < R_H \leqq 100$) when the lamp voltage falls below a predetermined value V', and the control means is further configured to change the content rate stepwise when the content rate is shifted from $R_L$% to $R_H$%, or when the content rate is shifted from $R_H$% to $R_L$%.

A third aspect of the present invention is a high pressure discharge lamp ballast for driving a high pressure discharge lamp with a synthesized-waveform alternating current made of a plurality of frequency components f1 to fn ($n \geqq 3$, fn−1<fn), the high pressure discharge lamp including a pair of electrodes disposed to face each other, the ballast including: a control means for controlling a component contained ratio of the frequency components f1 to fn per unit time; an output means for applying a synthesized-waveform current in accordance with the component contained ratio to the high pressure discharge lamp; and a detection means for detecting a lamp voltage of the high pressure discharge lamp. In the high pressure discharge lamp ballast, the control means is configured to shift the component contained ratio to a first component contained ratio $C_1$ when the lamp voltage exceeds a predetermined value V, and to shift the component contained ratio to a second component contained ratio $C_2$ when the lamp voltage falls below a predetermined value V', an average frequency of the second component contained ratio $C_2$ is higher than an average frequency of the first component contained ratio $C_1$, and the control means is further configured to change the component contained ratio stepwise when the component contained ratio is shifted from the first component contained ratio $C_1$ to the second component contained ratio $C_2$, or when the component contained ratio is shifted from the second component contained ratio $C_2$ to the first component contained ratio $C_1$.

In the first to third aspects of the present invention, the stepwise change in any one of the component contained ratio and the content rate is designed to be completed in one minute to one hour per shift.

Further, the stepwise change in any one of the component contained ratio and the content rate is designed to be completed in 10 minutes to 30 minutes per shift.

In addition, when the high pressure discharge lamp ballast is used in a projector, the plurality of frequency components are designed to be frequency components not interfering with a video synchronization signal used for the projector.

A fourth aspect of the present invention is a light source apparatus comprising a projector including the high pressure discharge lamp ballast and the high pressure discharge lamp according to the first to third aspects.

A fifth aspect of the present invention is a high pressure discharge lamp ballast for driving a high pressure discharge lamp with a synthesized-waveform alternating current, the high pressure discharge lamp including a pair of electrodes disposed to face each other, the ballast being used in a DLP (Digital Lighting Processor) system employing a color wheel. In the high pressure discharge lamp ballast, the synthesized-waveform current comprises a combination of a first set of current waveforms and a second set of current waveforms, the first and second sets are each in a waveform inverted so as to correspond to at least one of a rotational speed of the color wheel and divided positions of segments of the color wheel, a period of each of the first and second sets has a length equivalent to one rotation of the color wheel, and an average frequency of the second set is higher than an average frequency of the first set, the ballast comprises: a control means for controlling each of content rates of the first and second sets in the synthesized-waveform current per unit time; a detection means for detecting a synchronization signal for a rotation of the color wheel; an output means for applying a synthesized-waveform current in accordance with the synchronization signal and the content rates to the high pressure discharge lamp; and a detection means for detecting a lamp voltage of the high pressure discharge lamp, and the control means is configured to set a content rate of the second set at $R_L$% when the lamp voltage exceeds a predetermined value V, and to set the content rate of the second set at $R_H$% ($0=R_L<R_H=100$) when the lamp voltage falls below a predetermined value V', the control means further configured to change the content rate stepwise when the content rate is shifted from $R_L$% to $R_H$%, or when the content rate is shifted from $R_H$% to $R_L$%.

A sixth aspect of the present invention is a light source apparatus comprising a DLP system provided with the high pressure discharge lamp ballast, the high pressure discharge lamp, and the color wheel according to the fifth aspect.

BEST MODES FOR CARRYING OUT THE INVENTION

Figure 1:
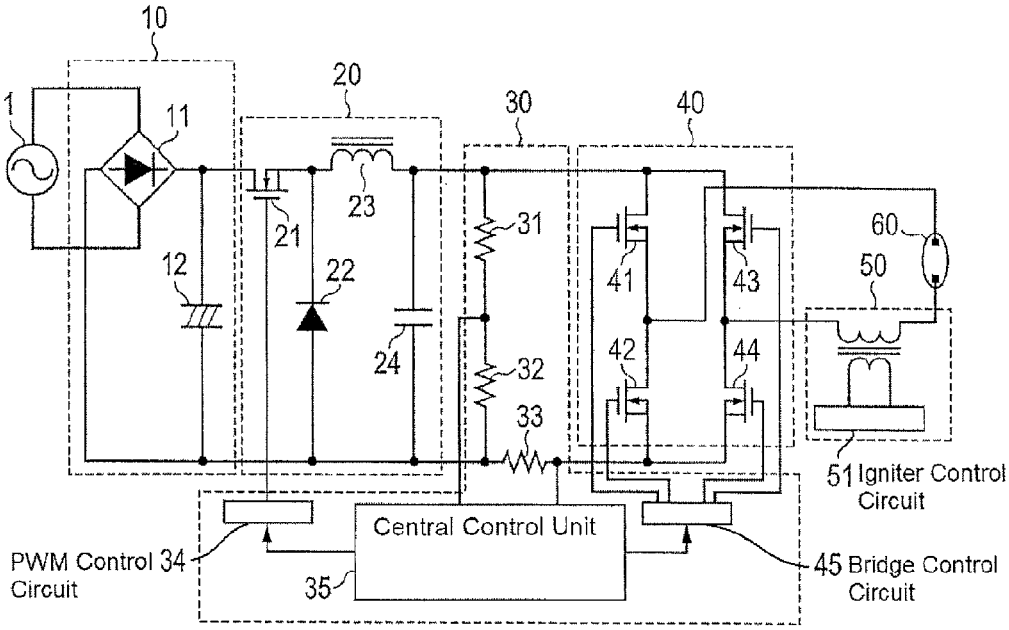
FIG. 1 is a circuit arrangement diagram showing a discharge lamp ballast of the present invention.

FIG. 1 is a circuit arrangement diagram of the present invention. Hereafter, description will be provided by referring to FIG. 1. A high pressure discharge lamp ballast of the present invention includes: a full-wave rectifying circuit 10; a step-down chopper circuit 20 for regulating the DC voltage of the full-wave rectifying circuit 10 into a predetermined lamp power or lamp current by a PWM (pulse width modulation) control circuit; a full-bridge circuit 40 for converting the DC output voltage of the step-down chopper circuit 20 to a square wave alternating current and applying the square wave alternating current to a lamp 60; an igniter circuit 50 for applying a high pulse voltage to the lamp at startup of the lamp; and a control circuit 30 for controlling the step-down chopper circuit 20 and the full-bridge circuit 40. It is noted that, for better understanding of the drawing, a full-wave rectifying, capacitor-input type circuit is shown as the rectifying circuit 10, however, a step-up circuit (power factor correction circuit) and the like may be also included if necessary.

The step-down chopper circuit 20 includes: a transistor 21 which is PWM-controlled by a PWM control circuit 34; a diode 22; a choke coil 23; and a smoothing capacitor 24. The step-down chopper circuit 20 is controlled such that the DC voltage supplied from the full-wave rectifying circuit 10 is converted to predetermined lamp power or lamp current. The full-bridge circuit 40 is controlled by a bridge control circuit 45 such that a pair of transistors 41 and 44 and a pair of transistors 42 and 43 are alternately turned on/off at a predetermined frequency. Thereby, a (basically, square wave) alternating current is applied to the lamp 60. The lamp 60 is assumed to be one with a rated power of approximately 50 to 400 W. The predetermined frequency and the value of the aforementioned predetermined lamp power or lamp current are determined by a central control unit 35 in the control circuit 30. In addition, in the central control unit 35, if necessary, a lamp current detected by a resistor 33 can be used for a constant lamp current control and a multiplied value of a lamp voltage and a lamp current detected by resistors 31 and 32 can be used for a constant lamp power control.

The present invention is to drive a high pressure discharge lamp at a synthesized driving frequency made of selected frequency components, to detect a lamp parameter at the time of driving, and to adjust a content rate (or component contained ratio, hereinafter the same) of each driving frequency per unit time in accordance with the detected result. Here, the description on the unit time is added. Although there is no particular limitation on time lengthwise, the unit time is preferably specified to be within several seconds, considering uniform stabilization of the lamp-driving conditions. Further, the content rate may be controlled by a control method with time and a control method with the number of cycles from which equivalent advantages are obtained. In this embodiment, the control with time is shown.

In the adjustment of the content rate, the lamp voltage, for example, is detected. When the detected result is lower than a certain reference value $V_A$, the content rate of f1 per unit time is adjusted to a lower value; in contrast, when the detected result is higher than another certain reference value $V_B$, the content rate of f1 per unit time is adjusted to be higher (reference value $V_A$<reference value $V_B$).

Figure 12:
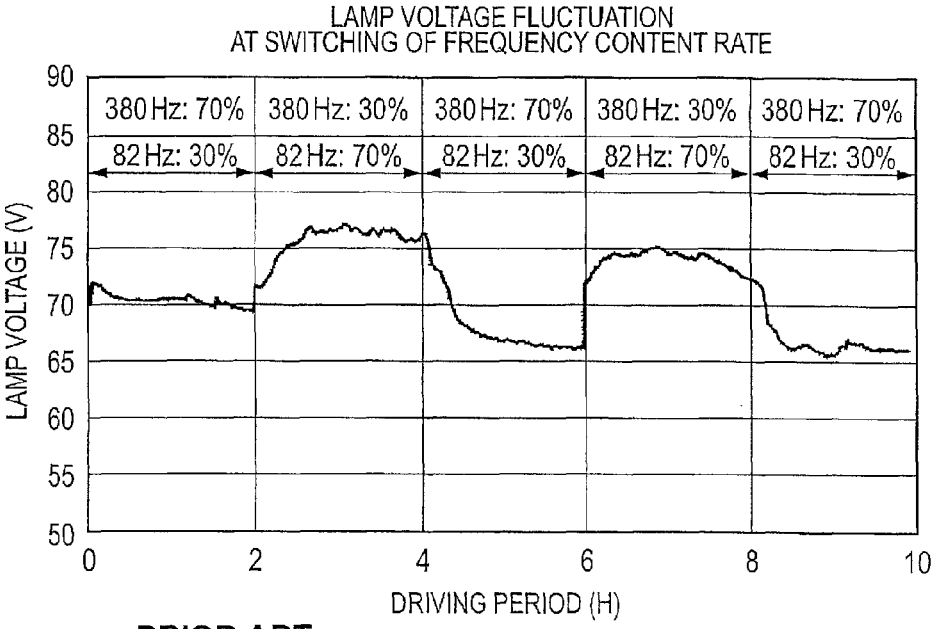
PRIOR ART FIG. 12
FIG. 12 is a view showing a fluctuation in lamp voltage by a conventional driving method.

Additionally, when the content rate per unit time is adjusted, a control is made such that the transition periods are set and the content rate is gradually changed stepwise. This is to avoid the following consequence. Specifically, if the content rate is changed quickly, the lamp voltage increases or decreases in a short term as shown in FIG. 12 (in contrast to the result intended in a long term), which causes unfavorable conditions such as a variation in brightness and an increase in component temperature as described above.

As a specific example of stepwise content-ratio adjustment, suppose a case where the content rates of, for example, (f1=30%/f2=70%) in the driving state are changed to be the content rates of (f1=70%/f2=30%). First, for example, the content rates are changed to (f1=60%/f2=40%), and the lamp is driven for five minutes. Next, the content rates are changed to (f1=50%/f2=50%), and the lamp is driven for five minutes. Then, the content rates are further changed to (f1=60%/f2=40%), and the lamp is driven for five minutes. Finally, the content rates are changed to (f1=70%/f2=30%).

The number of steps and the time for adjustment when such content rates of driving frequencies are adjusted will be described. The number of steps should be set as large as acceptable in the actual implementation. This is because it is a matter of course that as the number of steps is larger, the rate of change at each change point of the content rates becomes smaller so that the fluctuation in lamp voltage can be made smaller. With respect to the time, similarly, the longer the time, the smaller the change at each change point of the content rates. However, if the time is excessively long, it takes too much time for the change to the final content rates, and it takes a time for the lamp-voltage control, as well, which could prevent the appropriate lamp-voltage control. Thus, the time is desirably set within approximately one hour.

Design Example 1

Taking the above points into consideration, the inventors designed a high pressure discharge lamp ballast as follows, which is an example of the most preferable embodiment of the present invention.

Here, the frequencies that were limited by a light source apparatus (liquid crystal projector) used in this embodiment were 50 Hz, 82 Hz, 110 Hz, 165 Hz, 190 Hz, and 380 Hz. Thus, 82 Hz and 380 Hz were selected as the driving frequencies. The rated power of the lamp used is 170 W.

The (finally reached) frequency component contained ratios for driving the lamp were two sets: C1L (82 Hz=70%/380 Hz=30%) and C1H (82 Hz=30%/380 Hz=70%). The unit time is one second.

Here, the high pressure discharge lamp ballast detects a lamp voltage while the lamp is driven. The lamp is to be driven at C1L when the lamp voltage exceeds a reference value V1, and the lamp is to be driven at C1H when the lamp voltage falls below the reference value V1. In this respect, the reference value V1 is a value with hysteresis. The reference value V1 used for switching C1L to C1H is 65 V, while a reference value V1' used for switching C1H to C1L is 75 V.

The transition-period specification during these switchings is as follows. Specifically, when the lamp voltage falls below V1 (65 V), the ratios are shifted in a manner of C1L→C1*a*→C1*b*→C1*c*→C1H; when the lamp voltage exceeds V1' (75 V), the ratios are shifted in a manner of C1H→C1*c*→C1*b*→C1*a*→C1L. The durations of C1*a*, C1*b*, and C1*c* are each five minutes.

C1L: (82 Hz=70%/380 Hz=30%)
C1*a*: (82 Hz=60%/380 Hz=40%) [5-minute duration]
C1*b*: (82 Hz=50%/380 Hz=50%) [5-minute duration]
C1*c*: (82 Hz=40%/380 Hz=60%) [5-minute duration]
C1H: (82 Hz=30%/380 Hz=70%)

Figure 2:
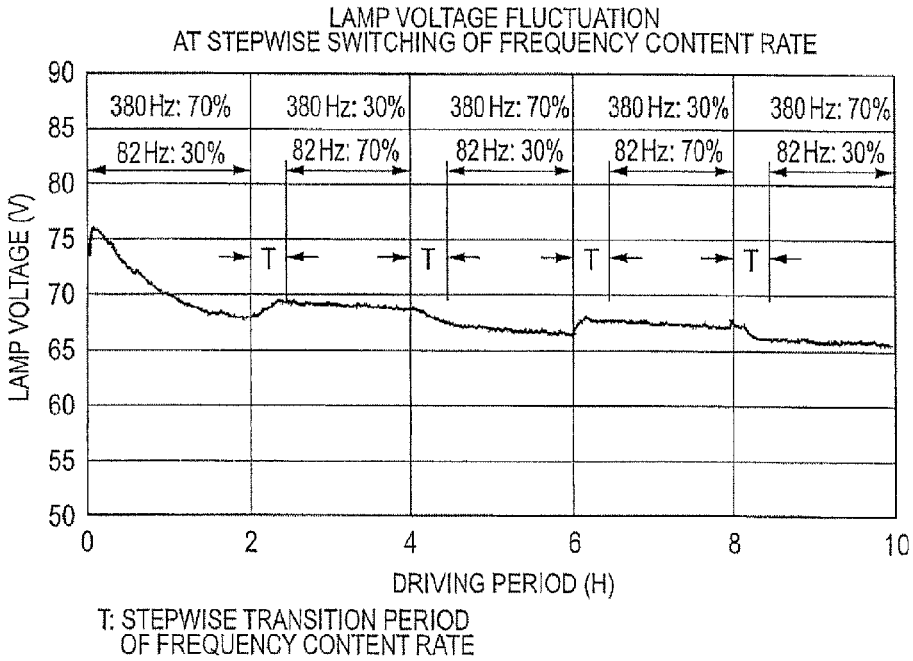
FIG. 2 is a view showing a fluctuation in lamp voltage by a driving method of the present invention.

FIG. 2 is a graph showing a behavior of the lamp voltage, which is the result of an experiment where the frequency content rates are changed every two hours in the Design Example described above. In FIG. 2, periods indicated by T are transition periods between C1L and C1H described above, and the other periods are periods when either C1H or C1L is maintained. In this Design Example, although each of the transition periods T is 15 minutes, the equivalent advantages can be obtained as long as T is approximately one minute or longer. As mentioned above, if the advantage of suppressing the short-term fluctuation only is sought, T should be long. However, from the viewpoint of actual use as a light source apparatus, T is desirably within one hour. Thus, in consideration of the advantage of stepwise changing and the actual use, T is desirably approximately one minute to one hour, more preferably approximately 10 minutes to 30 minutes.

Under this stepwise adjustment, it was confirmed that the fluctuation in lamp voltage caused by changing the content rates of driving frequencies was only approximately 2V to 3V, and that the fluctuation was suppressed significantly to a low level in comparison with that obtained by the control in which the content rates are quickly changed. This allows the appropriate lamp-voltage control.

Design Example 2

The specifications of the combination of content rates of driving frequencies and the transition period were made as follows, with the same light source apparatus and lamp as those in Design Example 1.

As the driving frequencies, 82 Hz, 110 Hz, and 380 Hz were selected. The frequency component contained ratios for driving (maintaining) the lamp were three sets: C2M (82 Hz=40%/110 Hz=20%/380 Hz=40%), C2L (82 Hz=60%/110 Hz=20%/380 Hz=20%), and C2H (82 Hz=20%/110 Hz=20%/380 Hz=60%). The unit time for determining the content rate was one second. Under these conditions, the lamp is driven at C2M during the steady driving period.

Here, the high pressure discharge lamp ballast detects a lamp voltage while the discharge lamp is driven. When the lamp voltage exceeds a reference value V2, the frequency combination is switched from C2M to C2L. Here, the reference value V2 is set to 80 V, and the transition-period specification during switching in this case is that the frequency combinations are shifted in a manner of the following C2M→CLa→CLb→CLc→C2L when the lamp voltage exceeds V2 (80 V).

C2M: (82 Hz=40%/110 Hz=20%/380 Hz=40%)

CLa: (82 Hz=45%/110 Hz=20%/380 Hz=35%) [5-minute duration]

CLb: (82 Hz=50%/110 Hz=20%/380 Hz=30%) [5-minute duration]

CLc: (82 Hz=55%/110 Hz=20%/380 Hz=25%) [5-minute duration]

C2L: (82 Hz=60%/110 Hz=20%/380 Hz=20%)

The stepwise change of the content rate combination to C2L in this manner allows the lamp voltage to start decreasing gradually without increasing in a short term. Then, when the lamp voltage falls below the reference value V2 again, the content rate combination is controlled to return from C2L to C2M. It is noted that, in order to stabilize the switching control for content rate combination, the reference value V2 has hysteresis, and a reference value V2' in this case is 77 V. The transition-period specification during switching in this case is that the frequency combinations are shifted in a manner of the following C2L→CLc→CLb→CLa→C2M when the lamp voltage falls below V2' (77 V).

C2L: (82 Hz=60%/110 Hz=20%/380 Hz=20%)

CLc: (82 Hz=55%/110 Hz=20%/380 Hz=25%) [5-minute duration]

CLb: (82 Hz=50%/110 Hz=20%/380 Hz=30%) [5-minute duration]

CLa: (82 Hz=45%/110 Hz=20%/380 Hz=35%) [5-minute duration]

C2M: (82 Hz=40%/110 Hz=20%/380 Hz=40%)

In contrast, when the lamp voltage falls below a reference value V3, the content rate combination is switched from C2M to C2H. Here, the reference value V3 is set to 60 V, and the transition-period specification during switching in this case is that the frequency combinations are shifted in a manner of the following C2M→CHa→CHb→CHc→C2H when the lamp voltage falls below V3 (60 V).

C2M: (82 Hz=40%/110 Hz=20%/380 Hz=40%)

CHa: (82 Hz=35%/110 Hz=20%/380 Hz=45%) [5-minute duration]

CHb: (82 Hz=30%/110 Hz=20%/380 Hz=50%) [5-minute duration]

CHc: (82 Hz=25%/110 Hz=20%/380 Hz=55%) [5-minute duration]

C2H: (82 Hz=20%/110 Hz=20%/380 Hz=60%)

The stepwise change of the content rate combination to C2H in this manner allows the lamp voltage to start increasing gradually without decreasing in a short term. Then, when the lamp voltage exceeds the reference value V3 again, the content rate combination is controlled to return from C2H to C2M. The reference value V3 also has hysteresis as the reference value V2 does, and a reference value V3' in this case is 63 V. The transition-period specification during switching in this case is that the frequency combinations are shifted in a manner of the following C2H→CHc→CHb→CHa→C2M when the lamp voltage exceeds V3' (63 V).

C2H: (82 Hz=20%/110 Hz=20%/380 Hz=60%)

CHc: (82 Hz=25%/110 Hz=20%/380 Hz=55%) [5-minute duration]

CHb: (82 Hz=30%/110 Hz=20%/380 Hz=50%) [5-minute duration]

CHa: (82 Hz=35%/110 Hz=20%/380 Hz=45%) [5-minute duration]

C2M: (82 Hz=40%/110 Hz=20%/380 Hz=40%)

Although the transition period T in this Design Example is also 15 minutes, equivalent advantages are obtained, as in the case of Design Example 1, as long as T is approximately one minute or longer. T is desirably approximately one minute to one hour, more preferably approximately 10 minutes to 30 minutes.

Although there is no problem in Design Example 1 in actual use, the above-described pattern allows further reduction of the fluctuation amount in lamp voltage, and thus the appropriate lamp-voltage control can be achieved.

Design Example 3

Figure 3:
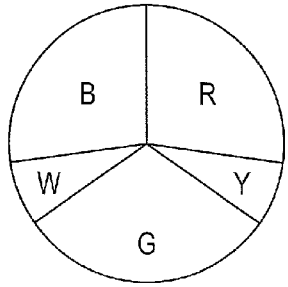
FIG. 3 is a view showing a color wheel.

Specifications were made so as to be suitable for a combination of the same lamp as those in Design Example 1 and Design Example 2 with a light source apparatus employing a so-called DLP system using a reflection-type mirror device. Here, the number of rotations of a color wheel used in the DLP system is 100 Hz. The color wheel is divided into five segments of red (R), green (G), blue (B), white (W), and yellow (Y) as shown in FIG. 3. The angles of the respective segments are: red (R)=100 deg, green (G)=100 deg, blue (B)=100 deg, white (W)=30 deg, and yellow (Y)=30 deg.

Figure 4A:
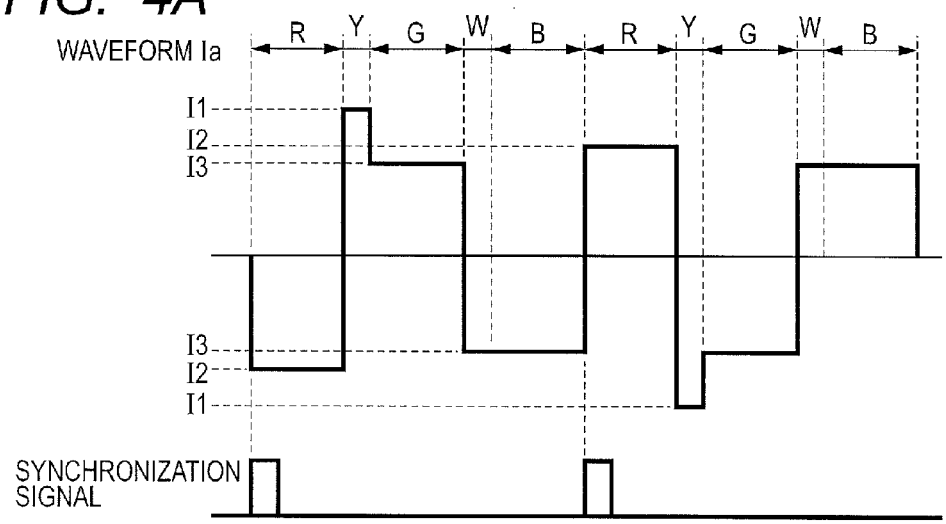
FIG. 4A is a view showing a lamp current synchronized with the color wheel.

Further, a synchronization signal from the light source apparatus and a current waveform supplied from the ballast to the lamp are synchronized with the segments of the color wheel as shown in FIG. 4A, and have different values for the corresponding segments. The current values of the respective segments are: I(Y)=I1, I(R)=I2, I(G)=I(B)=I(W)=I3. The current waveform of this case is represented as Ia.

As shown in FIG. 4A, the waveform Ia has three polarity inversions in one rotation of the color wheel (in this description, the number of inversions does not include a starting portion of one set of the lamp current waveform, but includes an ending portion thereof). Thus, the number of inversions per second is 300, which corresponds to 150 Hz when converted into frequency. The average frequency in one set of lamp current waveform between synchronization signals was set to 150 Hz.

Figure 4B:
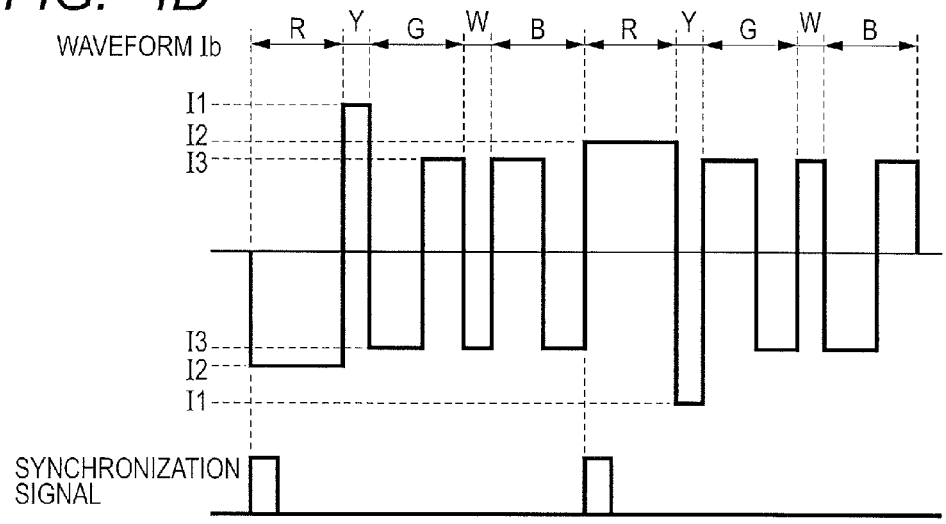
FIG. 4B is a view showing a lamp current synchronized with the color wheel.

Meanwhile, as shown in FIG. 4B, the waveform Ib has a polarity inversion at each switching point of the segments, and further has one polarity inversion inserted in each segment of green (G) and blue (B). The number of polarity inversions in one rotation of the color wheel was set to seven. Thus, the number of inversion corresponds to 350 Hz when converted into frequency, and the average frequency in one set between synchronization signals was set to 350 Hz.

In this Design Example, these waveforms Ia and Ib were used, and the content rate combinations were set as: C3L (Ia: 150 Hz=100%/Ib: 350 Hz=0%) and C3H (Ia: 150 Hz=0%/Ib: 350 Hz=100%). The unit time is one second.

Here, the high pressure discharge lamp ballast detects a lamp voltage while the lamp is driven. The lamp is to be driven at C3L when the lamp voltage exceeds a reference value V4. The lamp is to be driven at C3H when the lamp voltage falls below the reference value V4. Here, the reference value V4 is a value with hysteresis. The reference value V4 used for switching C3L to C3H is 65 V, while a reference value V4' used for switching C3H to C3L is 75 V.

The transition-period specification during switching in this case is that the frequency combinations are shifted in a manner of C3L→C3*a*→C3*b*→C3*c*→C3*d*→C3H when the lamp voltage falls below V4 (65 V), while the transition-period specification during switching in this case is that the frequency combinations are shifted in a manner of C3H→C3*d*→C3*c*→C3*b*→C3*a*→C3L when the lamp voltage exceeds V4' (75 V).

C3L: (Ia: 150 Hz=100%/Ib: 350 Hz=0%)
C3*a*: (Ia: 150 Hz=80%/Ib: 350 Hz=20%) [5-minute duration]
C3*b*: (Ia: 150 Hz=60%/Ib: 350 Hz=40%) [5-minute duration]
C3*c*: (Ia: 150 Hz=40%/Ib: 350 Hz=60%) [5-minute duration]
C3*d*: (Ia: 150 Hz=20%/Ib: 350 Hz=80%) [5-minute duration]
C3H: (Ia: 150 Hz=0%/Ib: 350 Hz=100%)

Although the transition period T in this Design Example is 20 minutes, as in the case of Design Example 1, T is desirably approximately one minute to one hour, more preferably approximately 10 minutes to 30 minutes.

The above-described pattern allows the appropriate lamp-voltage control, even when the driving frequencies are limited by the specifications of the color wheel.

It is noted that, besides the above-described five-color type, the color wheel includes: a three-primary color type of red (R), green (G) and blue (B); a four-color type in which cyan (C) is added to the three primary colors; a six-color type in which the complementary colors of yellow (Y), magenta (M) and cyan (C), are added to the three primary colors; and the like. Each of these types has variations in divided angle or arrangement of segments or in rotational speed of the color wheel. Thus, the present invention is applicable by determining the number of inversions and the position of inversion in accordance with the specifications of each color wheel.

Light Source Apparatus.

In the embodiment described above, the high pressure discharge lamp ballast with the improved lamp-voltage control has been illustrated. As an application using the same, FIG. 8 shows a light source apparatus.

Figure 8:
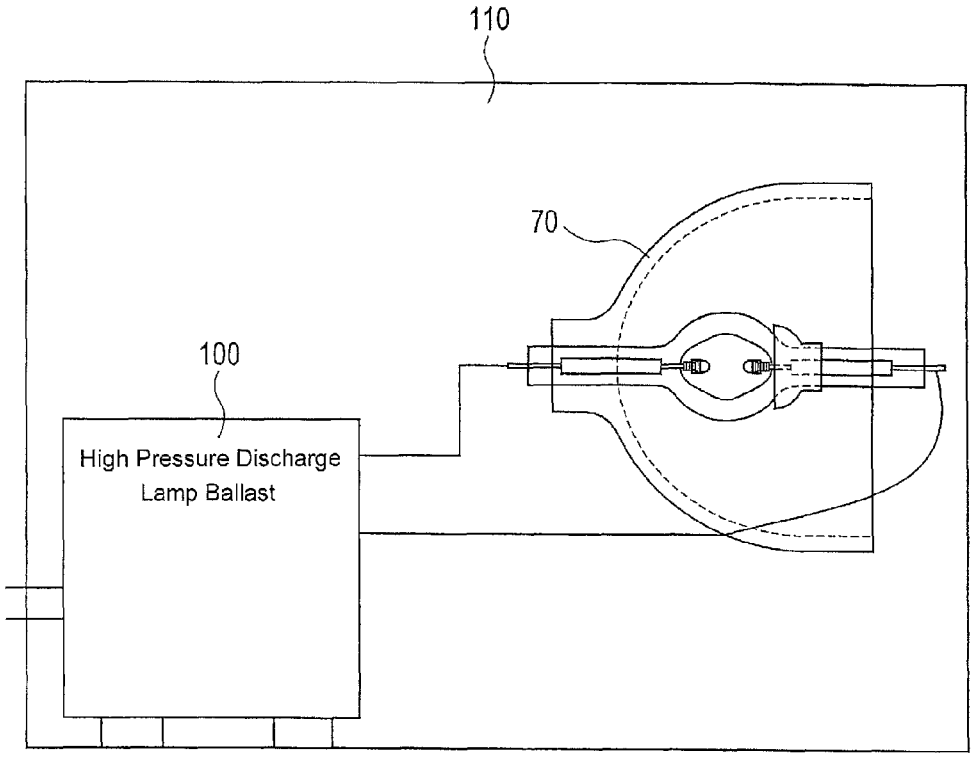
FIG. 8 is a view illustrating a light source apparatus of the present invention.
Figure 9:
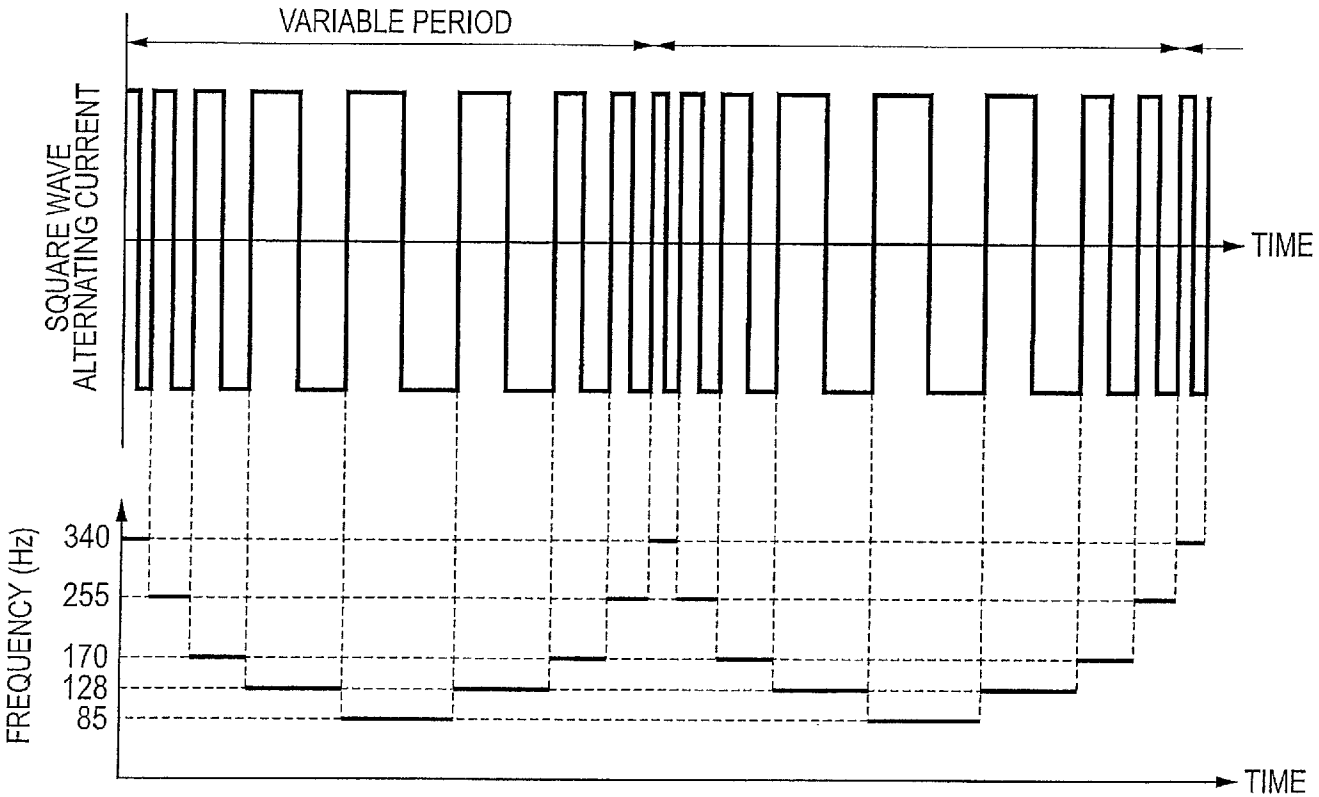
FIG. 9 is a view showing a lamp current in a conventional driving method.
Figure 10A:
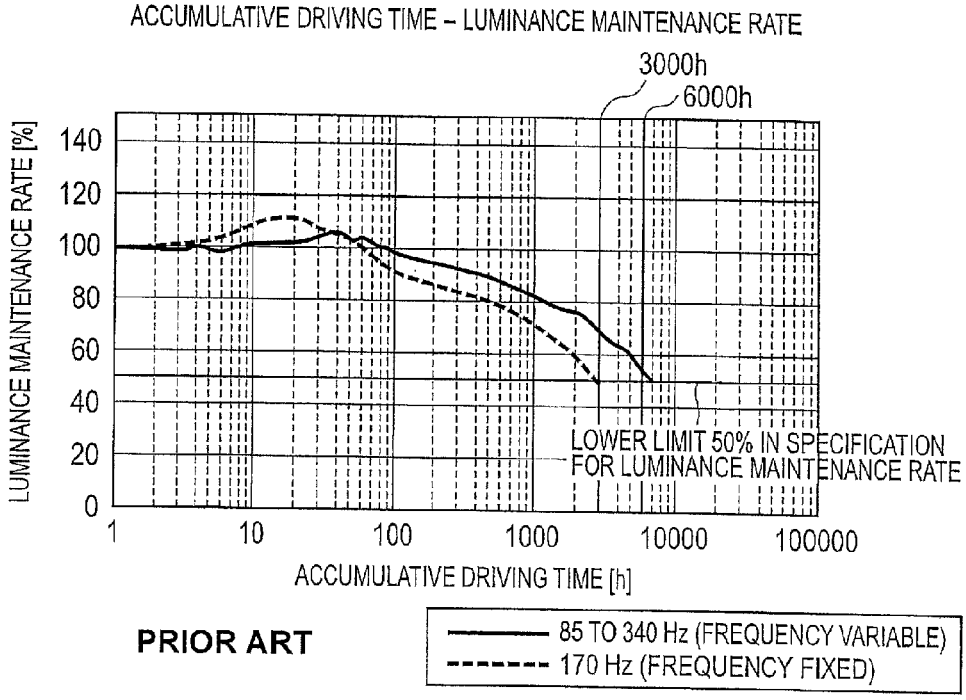
FIG. 10A is a view showing fluctuations in accumulative driving time, a luminance maintenance rate, and a lamp voltage by the conventional driving method.
Figure 10B:
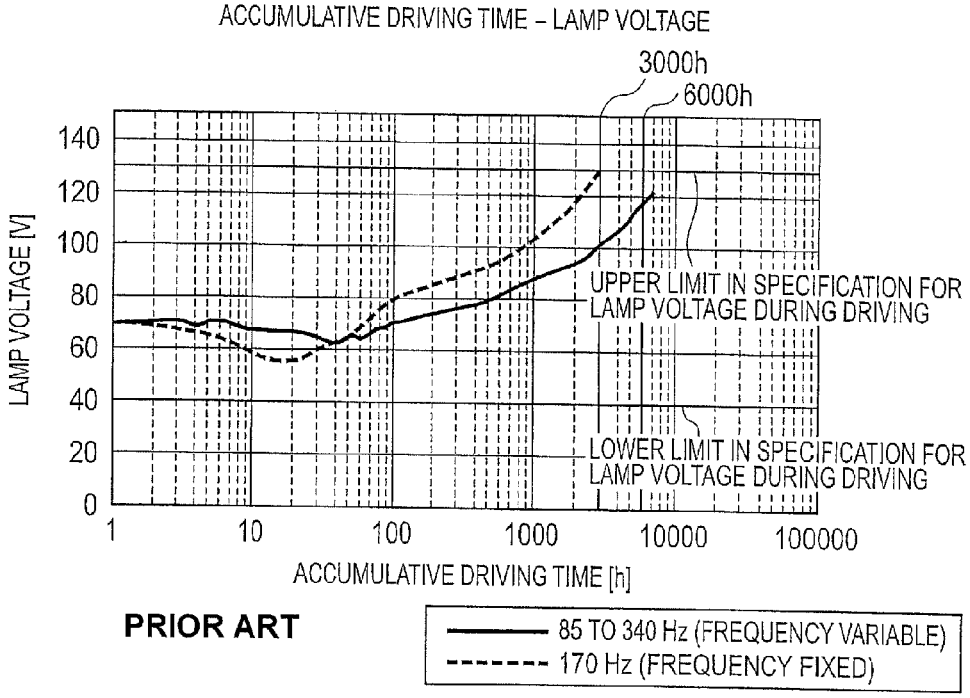
PRIOR ART FIG. 10B
FIG. 10B is a view showing fluctuations in accumulative driving time, a luminance maintenance rate, and a lamp voltage by the conventional driving method.
Figure 11:
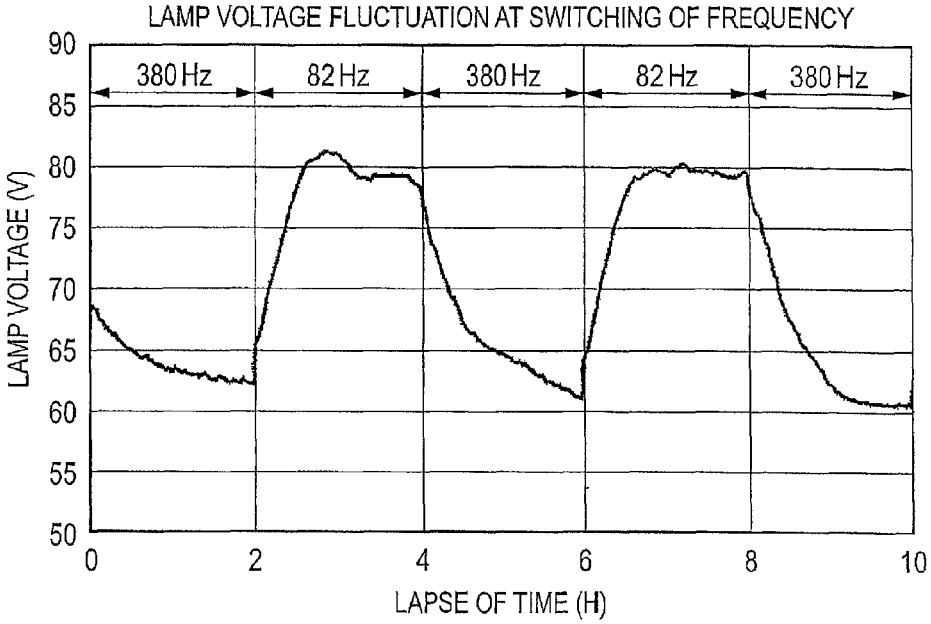
FIG. 11 is a view showing a fluctuation in lamp voltage by a conventional driving method.

In FIG. 8, 100 denotes the above-described high pressure discharge lamp ballast in FIG. 1, 70 denotes a reflector to which a lamp is attached, and 110 denotes a housing which houses the high pressure discharge lamp ballast and the lamp. It is to be noted that the drawing schematically illustrates the embodiment, and hence dimensions, arrangements, and the like are different from those in the drawing. Additionally, a projector is configured with appropriately disposing members of an unillustrated image system, or the like, in the housing.

Further, in the case of the DLP system, a color wheel (not shown) is included herein.

This configuration can provide a highly reliable projector with the luminance controlled as appropriate. Furthermore, the above-described advantages can be achieved even when multiple frequencies are used which are limited by the signal of the image system of the projector or use of the color wheel, which increases the versatility of the high pressure discharge lamp ballast.

It is noted that the above embodiment has been presented as the most preferable examples of the present invention. Related to this respect, the following notes are provided.

Figure 5:
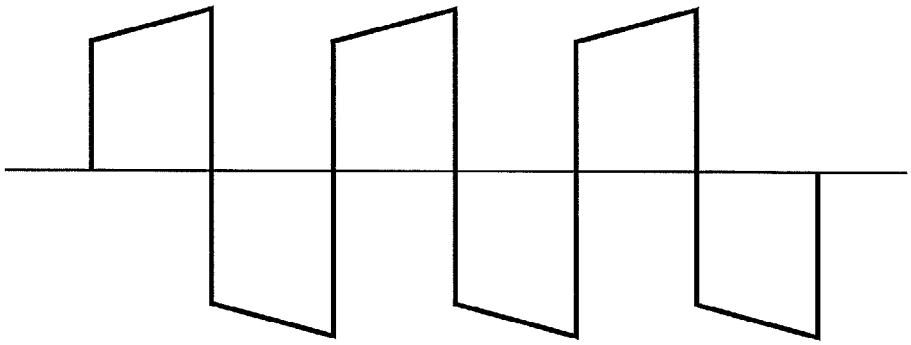
FIG. 5 is a view illustrating the present invention.
Figure 6:
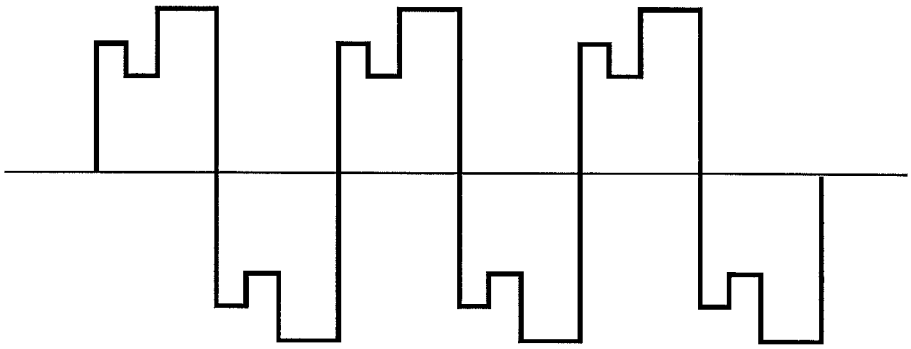
FIG. 6 is a view illustrating the present invention.
Figure 7:
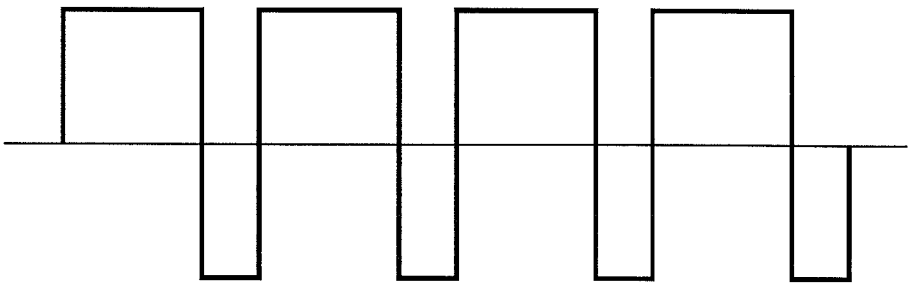
FIG. 7 is a view illustrating the present invention.

(1) The "square wave" as the output current in this embodiment includes a waveform that is not a complete square wave in a strict sense. Examples of the "square wave" which are not complete square waves include: a waveform as in FIG. 5 in which a current value at the start of a half cycle of a square wave slightly differs from a current value at the end thereof; a waveform as in FIG. 6 in which small projection and depression exists in the middle of a half cycle; and a waveform as in FIG. 7 in which a time product of the current differs for each polarity during the driving. Furthermore, the example also includes waveforms as in FIGS. 4A and 4B in which current values are changed synchronized with the segments of the color wheel used in the DLP system, and the polarities are changed. Thus, it is intended that the "square wave" includes such waveforms of the lamp current during the normal driving.

(2) In the present invention, the content rates of frequencies are expressed by percentage (%) on the basis of time partition. However, in the actual design, the time obtained by multiplying several fold the number of cycles of a certain frequency never strictly matches the time for the corresponding content rate. Accordingly, the values of content rates are approximate in some cases. Thus, a frequency may be interrupted in the middle of the cycle and driving may start at another frequency.

(3) In the present invention, while it is indicated to configure that a lamp voltage is used as a lamp parameter and that the low and high frequencies are switched from each other in accordance with the lamp voltage, a driving duration after the driving is started may be used as a lamp parameter, and the low and high frequencies may be switched from each other for every predetermined driving duration. In a case of the lamp whose behavior of the lamp voltage is known in advance, the switching operation can be carried out without the detection of the lamp voltage.

(4) In the embodiment, while an AC power supply circuit is configured of the rectifying circuit; the step-down chopper circuit; and the full-bridge circuit, other arrangement is also possible as long as the arrangement can supply the square wave alternating current to the lamp. For example, when the input power supply is a DC power supply, a DC/DC converter only may be provided at the pre-stage of the full-bridge circuit. Alternatively, other type of circuit such as a push-pull inverter may be used instead of the full-bridge circuit as long as the direct current can be converted into the alternating current.

(5) Further, the arrangement in the control circuit 30 may not be limited to the illustrated arrangement as long as the control circuit 30 can carry out the inversion controls of the transistors 41 to 44 in the full-bridge circuit 40 and performing the PWM control of the transistor 21 in the step-down chopper circuit 20.

According to the present invention, when the content rates (or component contained ratio, hereinafter the same) of multiple driving frequencies per unit time are changed, the content rates are changed stepwise to allow the suppression of the unnecessary increase or decrease in the lamp voltage which would otherwise occur in a short term. Thus, the desired lamp-voltage control is achieved.

Moreover, even when the possible driving frequencies are limited, the present invention can preferably control the lamp voltage by combining multiple driving frequencies, and further by changing the content rate of each frequency per unit time in accordance with the lamp parameter.

Furthermore, the control provided by the present invention is not a control in which frequencies are consecutively changed, and thus is a useful control also for the DLP system in which the limited frequencies due to the number of rotations and the number of segments of the color wheel can be selected.

EXPLANATION OF REFERENCE NUMERALS

1: AC power supply
10: full-wave rectifying circuit

11: diode bridge
12: capacitor
20: step-down chopper circuit
21: transistor
22: diode
23: choke coil
24: capacitor
30: control circuit
31, 32, 33: resistor
34: PWM control circuit
35: central control unit
40: full-bridge circuit
41, 42, 43, 44: transistor
45: bridge control circuit
50: igniter circuit
51: igniter control circuit
60: high pressure discharge lamp
70: reflector
100: high pressure discharge lamp ballast
110: projector housing

The invention claimed is:

1. A high pressure discharge lamp ballast for driving a high pressure discharge lamp with a synthesized-waveform alternating current made of frequency components f1 and f2 (f1<f2), the high pressure discharge lamp including a pair of electrodes disposed to face each other, the ballast comprising:

control means for controlling a rate of a time period of the frequency component f1 or f2 to time periods of the frequency components f1 and f2 per unit time;

output means for applying a synthesized-waveform current in accordance with the rate to the high pressure discharge lamp; and detection means for detecting a lamp voltage of the high pressure discharge lamp, wherein the control means is configured to shift the rate of the f2 to $R_L$% when the lamp voltage exceeds a first predetermined voltage value V, and to shift the rate of the f2 to $R_H$% ($0 \leqq R_L < R_H \leqq 100$) when the lamp voltage falls below a second predetermined voltage value V', and the control means is further configured to change the rate stepwise when the rate is shifted from $R_L$% to $R_H$%, or when the rate is shifted from $R_H$% to $R_L$%.

2. A high pressure discharge lamp ballast for driving a high pressure discharge lamp with a synthesized-waveform alternating current made of a plurality of frequency components f1 to fn ($n \geqq 3$, $fn-1<fn$), the high pressure discharge lamp including a pair of electrodes disposed to face each other, the ballast comprising:

a control means for controlling a ratio of respective time periods of the frequency components f1 to fn per unit time;

an output means for applying a synthesized-waveform current in accordance with the ratio to the high pressure discharge lamp; and a detection means for detecting a lamp voltage of the high pressure discharge lamp, wherein the control means is configured to shift the ratio to a first ratio $C_1$ when the lamp voltage exceeds a first predetermined voltage value V, and to shift the ratio to a second ratio $C_2$ when the lamp voltage falls below a second predetermined voltage value V', an average frequency of the second ratio $C_2$ is higher than an average frequency of the first ratio $C_1$, and the control means is further configured to change the ratio stepwise when the ratio is shifted from the first ratio $C_1$ to the second ratio $C_2$, or when the ratio is shifted from the second ratio $C_2$ to the first ratio $C_1$.

3. The high pressure discharge lamp ballast according to any one of claims 1 and 2, wherein the stepwise change in any one of the ratio and the rate is completed in one minute to one hour per shift.

4. The high pressure discharge lamp ballast according to any one of claims 1 and 2, wherein the stepwise change in any one of the ratio and the rate is completed in 10 minutes to 30 minutes per shift.

5. The high pressure discharge lamp ballast according to any one of claims 1 and 2, wherein when the high pressure discharge lamp ballast is used in a projector, the plurality of frequency components are frequency components not interfering with a video synchronization signal used for the projector.

6. A light source apparatus which is formed of a projector including the high pressure discharge lamp ballast and the high pressure discharge lamp according to any one of claims 1 and 2.

7. A high pressure discharge lamp ballast for driving a high pressure discharge lamp with a synthesized-waveform alternating current, the high pressure discharge lamp including a pair of electrodes disposed to face each other, the ballast being used in a digital lighting processor (DLP) system employing a color wheel, wherein the synthesized-waveform current comprises a combination of a first set of current waveforms and a second set of current waveforms, the first and second sets are each in a waveform inverted so as to correspond to at least one of a rotational speed of the color wheel and divided positions of segments of the color wheel, a period of each of the first and second sets has a length equivalent to one rotation of the color wheel, and an average frequency of the second set is higher than an average frequency of the first set, the ballast comprises:

control means for controlling a rate of a time period of the first or second set in the synthesized-waveform current per unit time;

detection means for detecting a synchronization signal for a rotation of the color wheel;

output means for applying a synthesized-waveform current in accordance with the synchronization signal and the rates to the high pressure discharge lamp; and detection means for detecting a lamp voltage of the high pressure discharge lamp, and the control means is configured to set the rate of the second set at $R_L$% when the lamp voltage exceeds a first predetermined voltage value V, and to set the rate of the second set at $R_H$% ($0 \leqq R_L < R_H \leqq 100$) when the lamp voltage falls below a second predetermined voltage value V', the control means further configured to change the rate stepwise when the rate is shifted from $R_L$% to $R_H$%, or when the rate is shifted from $R_H$% to $R_L$%.

8. A light source apparatus comprising a digital lighting processor (DLP) system including the high pressure discharge lamp ballast, the high pressure discharge lamp, and the color wheel according to claim 7.

9. A method for driving a high pressure discharge lamp with a synthesized-waveform alternating current made of frequency components f1 and f2 (f1<f2), the high pressure discharge lamp including a pair of electrodes disposed to face each other, the method comprising the steps of:

detecting a lamp voltage of the high pressure discharge lamp;

controlling a rate of a time period of the frequency component f1 or f2 to time periods of the frequency components f1 and f2 per unit time on the basis of the detected lamp voltage; and applying a synthesized-waveform current in accordance with the rates to the high pressure discharge lamp, wherein the controlling includes the steps of shifting the rate of the f2 to $R_L$% stepwise when the lamp voltage exceeds a first predetermined voltage value V; and shifting the rate of the f2 to $R_H$% stepwise when the lamp voltage falls below a second predetermined voltage value V', where $0 \leqq R_L < R_H \leqq 100$.

10. A method for driving a high pressure discharge lamp with a synthesized-waveform alternating current made of a plurality of frequency components f1 to fn ($n \geqq 3$, $fn-1<fn$), the high pressure discharge lamp including a pair of electrodes disposed to face each other, the method comprising the steps of:

detecting a lamp voltage of the high pressure discharge lamp;

controlling a ratio of respective time periods of the frequency components f1 to fn per unit time on the basis of the detected lamp voltage; and applying a synthesized-waveform current in accordance with the ratio to the high pressure discharge lamp, wherein the controlling includes the steps of shifting the ratio to a first ratio $C_1$ stepwise when the lamp voltage exceeds a first predetermined voltage value V, and shifting the ratio to a second ratio $C_2$ stepwise when the lamp voltage falls below a second predetermined voltage value V', the second ratio $C_2$ having an average frequency which is higher than an average frequency of the first ratio $C_1$.

11. The method according to any one of claims 9 and 10, wherein the stepwise change in any one of the ratio and the rate is completed in one minute to one hour per shift.

12. The method according to any one of claims 9 and 10, wherein the stepwise change in any one of the ratio and the rate is completed in 10 minutes to 30 minutes per shift.

13. The method according to any one of claims 9 and 10, wherein the plurality of frequency components are frequency components not interfering with a video synchronization signal used for a projector.

14. A method for driving a high pressure discharge lamp with a synthesized-waveform alternating current, the high pressure discharge lamp including a pair of electrodes disposed to face each other, the method being used in a digital lighting processor (DLP) system employing a color wheel, wherein the synthesized-waveform current comprises a combination of a first set of current waveforms and a second set of current waveforms, the first and second sets are each in a waveform inverted so as to correspond to at least one of a rotational speed of the color wheel and divided positions of segments of the color wheel, a period of each of the first and second sets has a length equivalent to one rotation of the color wheel, and an average frequency of the second set is higher than an average frequency of the first set, the method comprises the steps of:

detecting a lamp voltage of the high pressure discharge lamp;

controlling a rate of a time period of the first or second set in the synthesized-waveform current per unit time on the basis of the lamp voltage;

detecting a synchronization signal for a rotation of the color wheel; and applying a synthesized-waveform current in accordance with the synchronization signal and the rates to the high pressure discharge lamp, and the controlling includes the steps of setting the rate of the second set to $R_L$% stepwise when the lamp voltage exceeds a first predetermined voltage value V; and setting the rate of the second set to $R_H$% stepwise when the lamp voltage falls below a second predetermined voltage value V', where $0 \leqq R_L < R_H \leqq 100$.

* * * * *